US009587921B2

(12) United States Patent
Faxon

(10) Patent No.: US 9,587,921 B2
(45) Date of Patent: Mar. 7, 2017

(54) WARHEAD CASINGS AND METHODS OF MANUFACTURE

(71) Applicant: Robert T. Faxon, Cincinnati, OH (US)

(72) Inventor: Robert T. Faxon, Cincinnati, OH (US)

( * ) Notice: Subject to any disclaimer, the term of this patent is extended or adjusted under 35 U.S.C. 154(b) by 413 days.

(21) Appl. No.: 14/291,822

(22) Filed: May 30, 2014

(65) Prior Publication Data

US 2016/0245629 A1 Aug. 25, 2016

Related U.S. Application Data

(60) Provisional application No. 61/829,531, filed on May 31, 2013.

(51) Int. Cl.
*F42B 10/00* (2006.01)
*F42B 12/76* (2006.01)
*F42B 33/00* (2006.01)

(52) U.S. Cl.
CPC ..... *F42B 12/76* (2013.01); *F42B 33/00* (2013.01)

(58) Field of Classification Search
CPC ..... F42B 12/76; F42B 33/00
USPC ..... 102/473
See application file for complete search history.

(56) References Cited

U.S. PATENT DOCUMENTS 2,895,418 A 7/1959 Lyon
4,026,188 A * 5/1977 Woodruff ..... B63B 22/003 102/351
5,173,571 A * 12/1992 Montgomery ..... F42B 5/045 102/434
5,265,539 A * 11/1993 Kurschner ..... F42C 15/40 102/206
5,305,505 A 4/1994 Ruhlman
5,872,324 A * 2/1999 Watson, Jr. ..... F42C 9/142 102/247
6,105,505 A 8/2000 Jones
6,227,119 B1 * 5/2001 Schmacker ..... F42B 25/00 102/473
7,992,498 B2 8/2011 Ruhlman et al.
8,191,479 B2 * 6/2012 Ruhlman ..... F42B 1/028 102/200
2002/0121215 A1 9/2002 Bocker et al.
(Continued)

FOREIGN PATENT DOCUMENTS

EP 1166035 B1 7/2003
EP 1038152 B1 8/2004
(Continued)

*Primary Examiner* — Samir Abdosh
(74) *Attorney, Agent, or Firm* — Wood Herron & Evans LLP

(57) ABSTRACT

A warhead casing includes a nose region, a tail region, a tubular body region, and a central cavity extending along a lengthwise axis and having a first axial end and a second axial end. An aft wall is formed integrally with the tail region and extends radially toward the lengthwise axis to define the second end of the central cavity, and includes an aperture configured to receive a fuse device. A method of manufacturing a warhead casing includes forming a nose portion, a body portion, and a tail portion. The tail portion includes a circumferential outer wall defining an inner cavity, and an aft wall integrally formed with the circumferential outer wall and extending radially inward to define an axial end of the inner cavity. At least one of the nose portion or the tail portion is joined to the body portion.

9 Claims, 5 Drawing Sheets

(56) References Cited

U.S. PATENT DOCUMENTS

2012/0227609 A1* 9/2012 Volkmann ..... F42B 3/16
102/322

FOREIGN PATENT DOCUMENTS

EP 1594997 B1 8/2010
EP 2496908 B1 9/2013

* cited by examiner

WARHEAD CASINGS AND METHODS OF MANUFACTURE

CROSS-REFERENCE TO RELATED APPLICATIONS

This application claims the priority of U.S. Provisional Patent Application Ser. No. 61/829,531, filed on May 31, 2013, the disclosure of which is incorporated by reference herein in its entirety.

TECHNICAL FIELD

The present invention generally relates to bomb or warhead casings, and more particularly to warhead casings for penetration-type bombs, and related methods of manufacture.

BACKGROUND

A warhead casing for a penetration-type bomb is designed to penetrate into the ground or into a reinforced structure before the bomb is detonated. As shown in FIG. 1, a known warhead casing 1 typically includes three general regions: a nose region 2, a tubular body region 3, and a tail region 4 opposite the nose region 2. The nose region 2 is generally tapered in an ogive shape and the tubular body and tail regions 3, 4 have generally straight-walled tubular shapes. A payload of explosive material (not shown) is carried by the casing 1, such as within a central cavity 5 enclosed by the casing 1. A fuse 6 is provided for initiating the detonation of the payload of explosive material carried by the bomb, and is typically located in the tail region 4.

Many penetration-type bombs include sensors for sensing environmental conditions so as to determine an appropriate timing for the bomb to detonate. For example, the sensors might include audio sensors, motion or speed sensors, and the like, all of which can provide information relating to the environment of the bomb, which can be relevant to the timing of the explosion of the bomb. For example, the sensors may determine a depth that the casing has penetrated into the ground. The sensor, or power generator, known as the Fusing Unit or FZU, communicate with the fuse such as to activate the fuse or detonator and thereby provide control over when the bomb explodes.

In the known example shown in FIG. 1, such a sensor is positioned in a well or socket 7 formed in the tubular body region 3 approximately half-way between the nose region 2 and the tail region 4 of the casing 1. Such a socket 7 extends through the wall of the tubular body region 3 and into the central cavity 5 of the casing 1. The socket 7 is therefore positioned generally radially outward of the explosive payload in the tubular body region 3, and part-way between the nose region 2 and the tail region 4. A cable 8 extends from the sensor in the socket 7 into the central cavity 5, as shown in FIG. 1. The cable 8 extends rearwardly from the socket 7, through the central cavity 5, toward the tail region 4 to connect with the fuse device 6. Thereby, the sensor may communicate with the fuse 6 through the cable 8.

However, the placement of the sensor socket 7 in the tubular body region 3 renders casing 1, and other known casing designs, vulnerable to premature structural failure when impacting a target. In particular, upon impact with a target and prior to detonation, stresses may concentrate at and around the radially extending sensor socket 7. Consequently, the casing 1 may structurally fail and rupture in the body region 3 near the socket 7 prior to detonation, such that the subsequent explosion pattern is malformed.

Known warhead casings also include an aft closure device, such as aft closure 9, attachable to the tail region for closing the large opening defined by the tail region, and for retaining the fuse in the tail region. As shown in FIG. 1, for example, known aft closures, such as aft closure 9, are approximately the same diameter as the inside diameter of the tubular body region and/or the tail region, and are removably attached to an inner circumference of the casing in the tail region. The aft closure 9 may be attached by threaded engagement and/or held in place by a separate threaded retainer. Additional prior known examples are described in U.S. Pat. No. 6,105,505 and U.S. Pat. No. 5,305,505, the disclosures of which are incorporated herein by reference. Such aft closures are susceptible to premature, unintended detachment from the casing before detonation when the casing impacts a target. In particular, when the nose portion of the casing impacts a target, the casing, including the tail region, may compress axially and simultaneously expand radially. Such radial expansion in the tail region operates to weaken the attachment of the aft closure to tail region. Consequently, the aft closure may disengage from the casing prior to detonation and thereby enable the subsequent explosion to be directed axially outward through the exposed aft opening of the casing rather than primarily radially outward, as is generally desired for penetration-type bombs. Thus, where a radial explosion pattern is desired, the failure of the aft closure attachment results in an undesired, adverse explosion pattern.

Thus, for penetration-type bombs, it is important that the warhead casing remain generally intact after impact with the target and until detonation occurs. As discussed above, structural changes or failures in the casing, such as in the tubular body region or in the tail region with an aft closure device, can adversely affect explosion performance. Accordingly, improvements are needed in the technology areas relating to warhead casings to address the deficiencies of prior known casing designs.

SUMMARY

An exemplary warhead casing according to an embodiment of the invention includes a nose region, a tail region, and a tubular body region between the nose region and the tail region, the regions defining a lengthwise axis of the casing. The casing further includes a central cavity extending along the lengthwise axis and having a first axial end and a second axial end. An aft wall is formed integrally with the tail region and extends radially toward the lengthwise axis to define the second end of the central cavity. The aft wall includes an aperture configured to receive a fuse device.

A method of manufacturing a warhead casing according to an embodiment of the invention includes forming a nose portion, a body portion, and a tail portion. The tail portion is formed with a circumferential outer wall defining an inner cavity, and an aft wall integrally formed with the circumferential outer wall and extending radially inward to define an axial end of the inner cavity. The aft wall includes an aperture extending therethrough and configured to receive a fuse device. The method further includes joining at least one of the nose portion or the tail portion to the body portion.

Other features, benefits, and combinations will be apparent from the various figures of the drawings and the following detailed description of the illustrative embodiments herein.

BRIEF DESCRIPTION OF THE DRAWINGS

Like reference numerals are used to indicate like parts throughout the various figures of the drawing, wherein.

DETAILED DESCRIPTION

Figure 2:
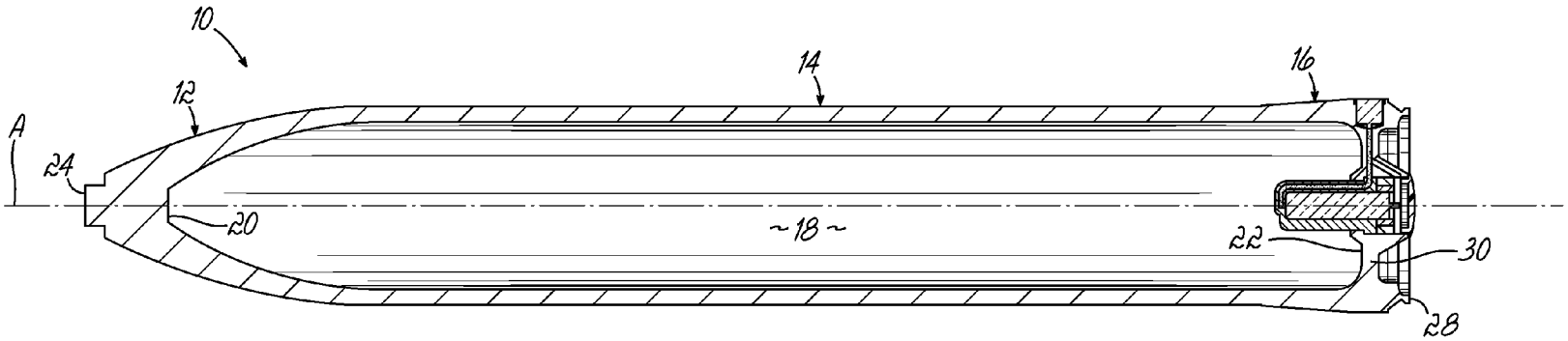
FIG. 2 is a cross-sectional schematic view showing a warhead casing according to an embodiment of the invention.

Referring to the figures, and beginning with FIG. 2, a warhead casing 10 according to an embodiment of the invention is shown. The casing 10 includes three general regions: a nose region 12, a tubular body region 14, and a tail region 16. As shown, the regions 12, 14, and 16 extend along a lengthwise axis A and may collectively define a central cavity 18 configured to carry an explosive payload (not shown). The central cavity 18 may have a first axial end 20 proximate the nose region 12, and a second axial end 22 proximate the tail region 16, such that the central cavity 18 is generally enclosed by the casing 10.

The nose region 12 is generally ogive-shaped and has a wall thickness that generally decreases away from a fore end 24 of the nose region 12 toward the tubular body region 14. The tubular body region 14 extends from the nose region 12 along the axis A and has a generally straight-walled tubular shape. The tail region 16 extends from the tubular body region 14 along the axis A and has a generally straight-walled or slightly flared tubular shape. As shown, the nose region 12 and tubular body region 14 may be structurally symmetric about the lengthwise axis A.

Figure 3:
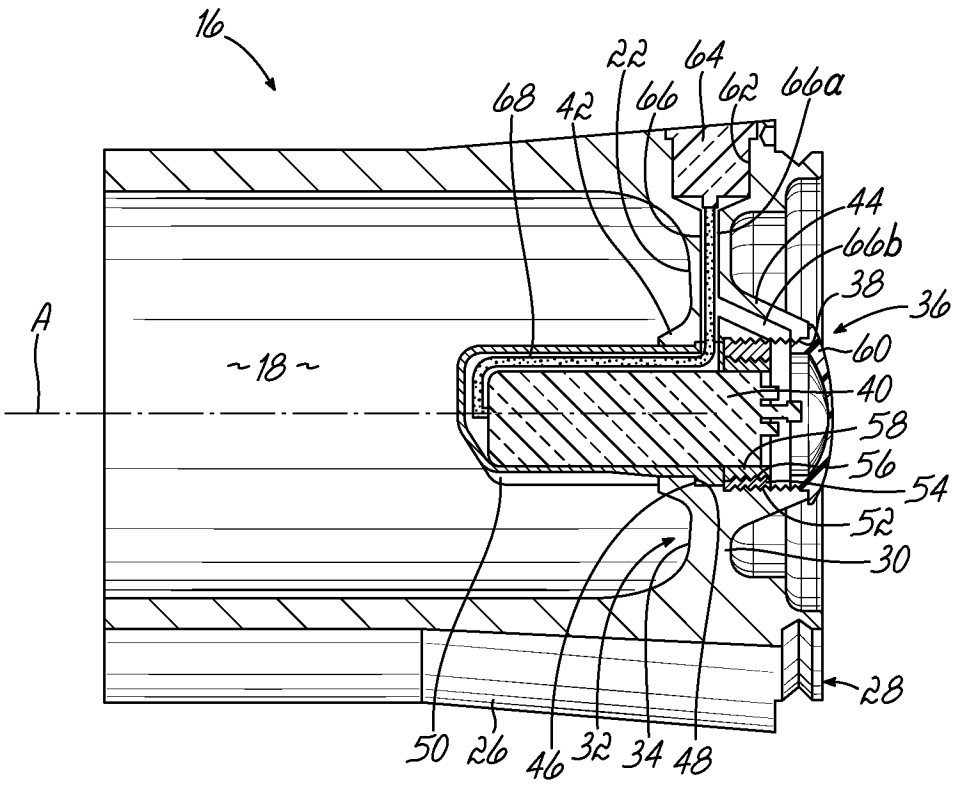
FIG. 3 is a cross-sectional schematic view showing details of a tail region of the warhead casing of FIG. 2.

Referring now to FIG. 3, additional structural details of the tail region 16 of the casing 10 will now be described. The tail region 16 includes a circumferential outer wall 26 and an aft end 28. As shown, the outer wall 26 may flare radially outward in a direction from the tubular body region 14 toward the aft end 28. An aft wall 30 is integrally formed with the outer wall 26 and extends radially inward toward the axis A to define the second axial end 22 of the central cavity 18. In particular, the aft wall 30 may be positioned slightly forward of the aft end 28 and may extend substantially transverse to the axis A. A circumferentially extending transition region 32 is defined where the aft wall 30 is integrally formed with the outer wall 26. The transition region 32 defines an annular pocket 34 that extends axially from the central cavity 18 toward the aft end 28 and is configured to contain a portion of the explosive payload (not shown). As shown, the transition region 32 may be rounded to provide the outer wall 26 with an increased radial thickness near the aft wall 28, thereby providing the tail region 16 with structural integrity superior to that of tail regions of prior known casing designs, as discussed in greater detail below.

The integral aft wall 30 includes a fuse socket 36 defining an aperture 38 that is sized to receive a fuse device 40 and thus has a diameter that is substantially smaller than a diameter of the central cavity 18 in the tail region 16. For example, as shown, the aperture 38 may be formed with a diameter that is approximately one-half or less of the diameter of the central cavity 18 in the tail region 16. The fuse socket 36 may include an inner collar portion 42 and an outer collar portion 44. The inner collar portion 42 extends axially from an interior side of the aft wall 30 toward the tubular body region 14, and tapers radially toward the axis A. The outer collar portion 44 extends axially from an exterior side of the aft wall 30 toward the aft end 28 and tapers radially toward the axis A. The inner collar portion 42 includes a ledge 46 that supports a shoulder 48 of a fuse well 50 that is received within the fuse socket 36. The fuse well 50 is configured to receive and support the fuse 40. The outer collar portion 44 includes a threaded portion 52 formed on a radially inner surface thereof. A fuse well retaining ring 54 is threaded into the threaded portion 52 to retain the fuse well 50 in the fuse socket 36. The fuse well retaining ring 54 includes an inner threaded portion 56 that is configured to receive a correspondingly threaded fuse retaining ring 58. The fuse retaining ring 58 is configured to retain the fuse 40 in the fuse well 50. A fuse protective cap 60 may be secured to the outer collar portion 44 to cover the fuse 40.

According to an important aspect of the invention, because the aft wall 30 is formed integrally with the tail region 16, it does not prematurely detach from the tail region 16 when the casing 10 compresses axially and swells radially upon impact with a target, prior to detonation. As discussed above, such pre-detonation detachment is a common failure mode of prior art casing designs fitted with large-diameter aft closure devices removably attached to a tail region. In this regard, the integrally formed aft wall 30 is suited to withstand, without detachment, axial and radial strains experienced by the casing 10 upon impact with a target and prior to detonation of the explosive payload, thereby enabling proper explosion performance. In particular, with reference to FIG. 3, as the tail region 16 of the casing 10 compresses axially and swells radially, radial stresses would be transferred from the outer wall 26 directly to the integrally formed aft wall 30, through the transition region 32. Consequently, the aft wall 30 would experience radial strains concurrently with the outer wall 26 of the tail region 16, rather than simply detaching from the tail region 16, as would occur in prior known casing designs. Accordingly, the integrally formed aft wall 30 may withstand target impact and enable a proper, radially directed explosion pattern.

A sensor socket 62 may be formed in the outer wall 26 of the tail region 16 for receiving a sensor or signal device 64. As shown, the sensor socket 62 is positioned generally rearward of the central cavity 18 and in axial alignment with the integral aft wall 30 such that a cable passageway 66 may extend radially from the sensor socket 62 through the aft wall 30 to the fuse device 40. The sensor or signal device 64 may be an FZU, for example.

Figure 1:
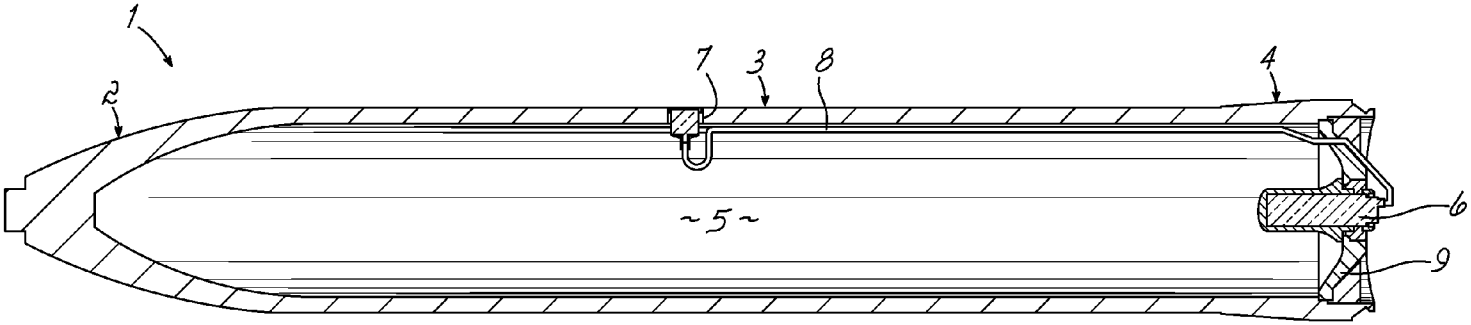
FIG. 1 PRIOR ART
FIG. 1 is a cross-sectional schematic view showing a known warhead casing.

The cable passageway 66 is configured to receive a cable 70 for connecting the sensor device 64 and the fuse 72, and may include a first branch 66*a* and a second branch 66*b*. As shown, the first branch 66*a* has a first portion that extends generally perpendicularly to the axis A toward the fuse 40 and a second portion that extends generally parallel to the axis A toward the tubular body region 14 and a fore end of the fuse 40. The second branch 66*b* has a first portion that extends generally obliquely to the axis A toward the aft end 28 and a second portion that extends generally perpendicularly to the axis A toward an aft end of the fuse 40. As shown, the cable 70 may be routed through the first branch 66*a* to connect to the fore end of the fuse 40 forward of the aft wall 30. Alternatively, though not shown, the cable 70 may be routed through the second branch 66*b* to connect to the aft end of the fuse 40 rearward of the aft wall 30. Thereby, various fuse configurations may be accommodated without routing the cable 70 through the central cavity 18 and the explosive payload carried therein, as is generally required by prior known casing designs, as shown in FIG. 1.

Advantageously, by positioning the sensor socket 62 and the sensor device 64 in the tail region 16, and in particular rearward of the central cavity 18, the tubular body region 14 does not include any peripheral openings extending into the central cavity 18 which might otherwise compromise the structural integrity of the casing upon target impact, as described above. In this regard, the embodiments shown and described herein provide warhead casings having nose regions and tubular body regions that are generally symmetric about the axis A. Accordingly, a common structural failure mode of prior known casing designs is eliminated by embodiments of the invention.

Methods of manufacturing warhead casings according to several embodiments of the invention will now be described. Unless otherwise indicated for the embodiments described below, a nose portion 82 generally corresponds to the nose region 12, a tubular portion 84 generally corresponds to the tubular body region 14, and a tail portion 86 generally corresponds to the tail region 16. In this regard, like reference numerals refer to like features. In particular, the tail portion 86 includes the same structural features as the tail region 16 described above, including the integrally formed aft wall 30.

Figure 4A:
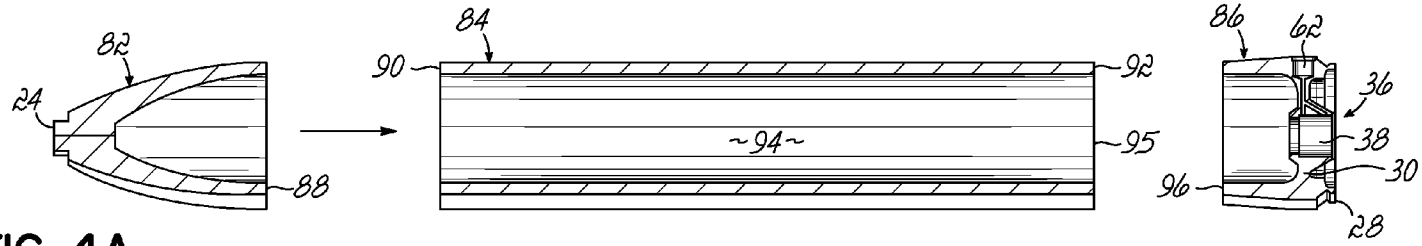
FIGS. 4A-4C are a series of cross-sectional schematic views showing the manufacture of a warhead casing according to a first embodiment of the invention.
Figure 4B:
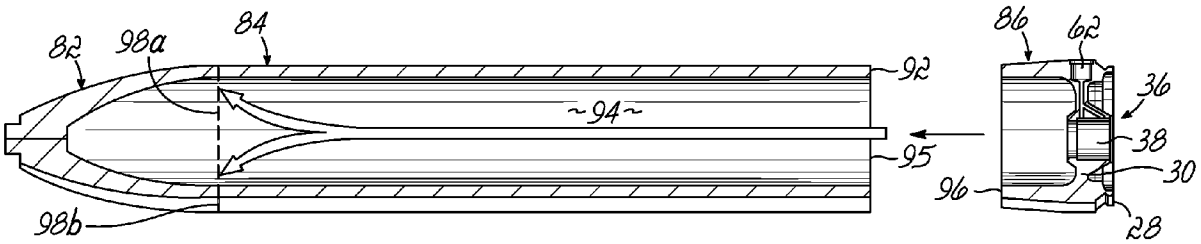
Figure 4C:
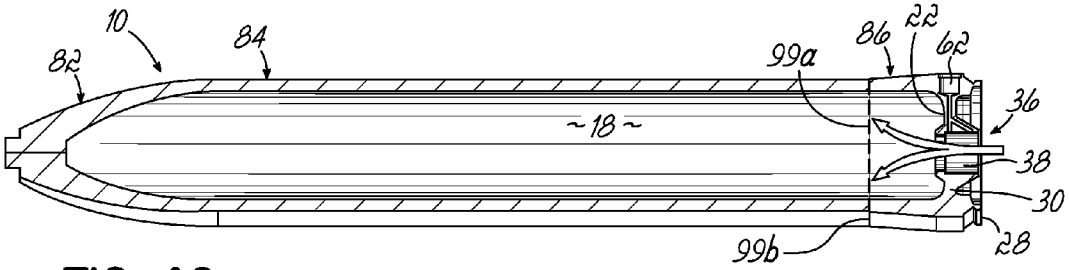

Referring to FIGS. 4A-4C, a method of manufacturing a warhead casing according to a first embodiment of the invention is shown. A solid stock of material (not shown), such as steel, may be cored, such as by trepanning, in order to form a tubular portion 84 and a corresponding plug (not shown), which may be divided into a first slug and a second slug (not shown). The first slug may be formed into a nose portion 82, for example by forging, deep drawing, or any other suitable method. The second slug may be formed into a tail portion 86 through similar metal forming methods. As shown in FIG. 4A, the nose portion 82 includes the fore end 24 and an aft end 88. The tubular portion 84 also includes a fore end 90 and an aft end 92, and defines a central bore 94 having a large diameter opening 95 at the aft end 92. The tail portion 86 includes a fore end 96 and the aft end 28. As described below, the nose portion 82, the tubular portion 84, and the tail portion 86 may be joined together to form the monolithic warhead casing 10.

As shown in FIGS. 4A and 4B, the aft end 88 of the nose portion 82 may be permanently joined with the fore end 90 of the tubular portion 84, such as by inertia welding, to form a first weld joint 98 having an interior aspect 98*a* and an exterior aspect 98*b*. After joining the nose portion 82 and the tubular portion 84, the first weld joint 98 may be processed to provide a smooth and continuous connection between the nose and tubular portions 82, 84. To that end, the joined unit may be heat-treated, and burrs, flash (known as rams horn), or other irregular surface features created during joining of the portions 82, 84, may be removed from both the interior and exterior aspects 98*a*, 98*b* of the first weld joint 98. For example, as indicated by the outlined arrows in FIG. 4B, the interior aspect 98*a* may be accessed through the large opening 95 defined by the aft end 92 of the tubular portion 84. The exterior aspect 98*b* may be accessed from the exterior of what was previously the separate nose and tubular portions 82, 84. Thereby, a smooth and continuous monolithic component may be created from the nose portion 82 and the tubular portion 84.

After the first weld joint 98 has been processed as described above, or least after the interior aspect 98*a* has been processed by gaining access through the opening 95 defined by the aft end 92 of the tubular portion 84, the tail portion 86 may be joined with the tubular portion 84. More specifically, as shown in FIGS. 4B and 4C, the fore end 96 of the tail portion 86 may be permanently joined with the aft end 92 of the tubular portion 84, such as by inertia welding, to form a second weld joint 99 having an interior aspect 99*a* and an exterior aspect 99*b*.

After joining the tubular portion 84 and the tail portion 86, the second weld joint 99 may be processed to provide a smooth and continuous connection between the tubular and tail portions 84, 86. In a similar manner as discussed above, burrs, flash (rams horn), and/or other irregular surface features created when the portions 84, 86 are joined may be removed from both the interior and exterior aspects 99*a*, 99*b* of the second weld joint 99. For example, the exterior aspect 99*b* may be accessed from the exterior of what was previously the separate portions 84, 86. As indicated by the outlined arrows in FIG. 4C, the interior aspect 99*a* may be accessed through the aperture 38 formed in what was previously the separate tail portion 86. Thereby, a smooth and continuous monolithic component may created from the nose portion 82, the tubular portion 84, and the tail portion 86, so as to form the monolithic casing 10. By processing the interior aspect 98*a* of the front weld joint 98 before the tail portion 86 is joined to the tubular portion 84, access to the interior aspect 98*a* is available through the large opening 95 defined by the aft end 92 of the tubular portion 84. As shown in FIG. 4C, the rear weld joint 99 is formed near the integral aft wall 30, and thus access to the rear weld joint 99 is available through the aperture 38 formed in the aft wall 30. Accordingly, the monolithic casing 10 may include interior and exterior surfaces having a smoothness that is at least comparable to that of prior known casings, while presenting a structure of improved integrity in view of the integrally formed aft wall 30. Moreover, reduced manufacturing costs may be achieved through the simplified manufacturing process described herein, which eliminates additional steps required for manufacturing a separate aft closure device as used in prior art designs, as shown in FIG. 1.

Figure 5A:
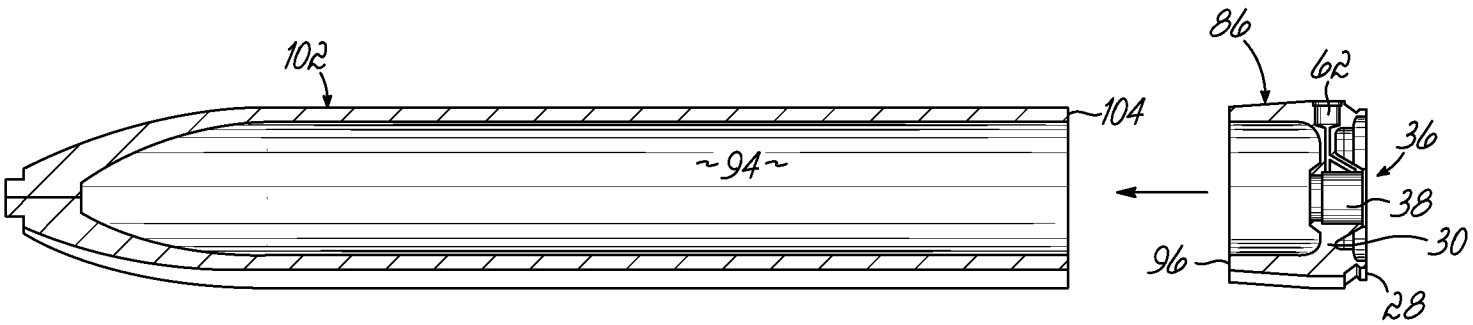
FIGS. 5A and 5B are a series of cross-sectional schematic views showing the manufacture of a warhead casing according to a second embodiment of the invention.
Figure 5B:
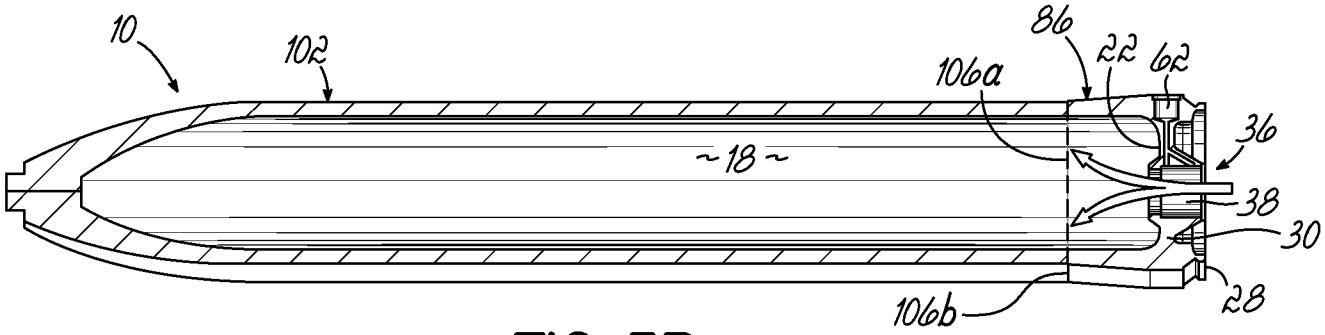

FIGS. 5A and 5B show a method of manufacturing a warhead casing according to a second embodiment of the invention. As shown in FIG. 5A, instead of forming the nose portion 82 and tubular portion 84 as independent pieces to be joined together, a monolithic front section 102 may be formed through a single forming step. In this regard, the front section 102 substantially corresponds in shape and design to the permanently joined nose portion 82 and tubular portion 84 shown in FIG. 4B. The front section 102 may be formed through deep drawing, forging, or any other suitable metal forming method. Advantageously, because the front section 102 is formed as a monolithic component without joining of parts, the front section 102 does not include any weld joints having aspects that must be further processed. Thus, this embodiment of the invention eliminates a manufacturing step and thereby yields savings in manufacturing time and costs. As shown in FIG. 5A, the tail portion 86 may be permanently joined at its fore end 96 to an aft end 104 of the front section 102, for example by inertia welding. Accordingly, a rear weld joint 106 is formed having an interior aspect 106*a* and an exterior aspect 106*b*, which may be further processed in the manners described above with respect to weld joints 98, 99. In particular, where the rear weld joint 106 is formed near the integral aft wall 30, the interior aspect 106*a* may be accessed through the aperture 38 formed in the aft wall 30, as indicated by the outlined arrows in FIG. 5B. Thereby, the monolithic casing 10 may be formed.

Figure 6A:
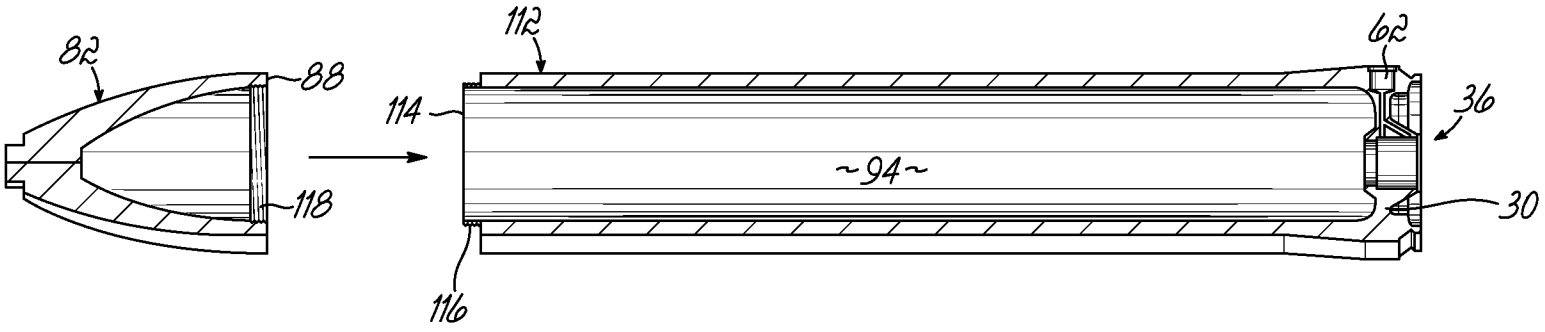
FIGS. 6A and 6B are a series of cross-sectional schematic views showing the manufacture of a warhead casing according to a third embodiment of the invention.
Figure 6B:
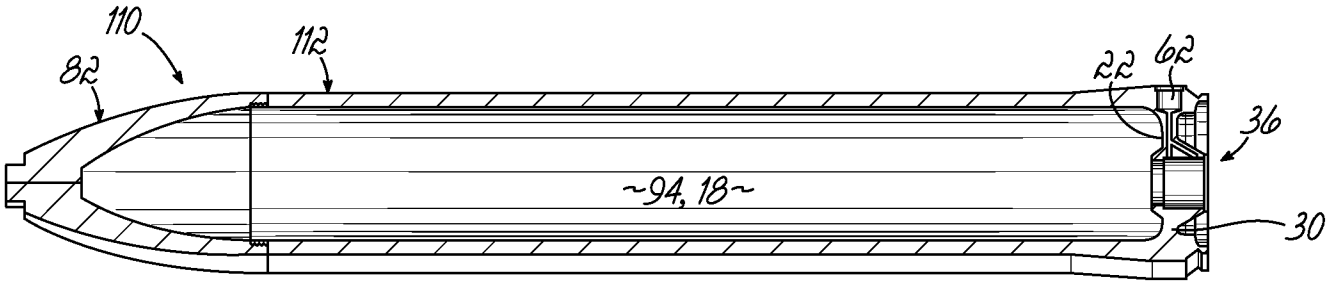

FIGS. 6A and 6B show a method of manufacturing a warhead casing according to a third embodiment of the invention. As shown, a casing 110 may include a monolithic rear section 112 to which the nose portion 82 is releasably attachable. As shown in FIG. 6A, instead of forming the tubular portion 84 and the tail portion 86 as independent pieces to be joined together, the monolithic rear section 112 may be formed through a single forming step. In this regard, the rear section 112 substantially corresponds in shape and design to the permanently joined tubular portion 84 and tail portion 86 shown in FIG. 4C (without the nose portion 82). The rear section 112 may be formed through deep drawing, forging, or any other suitable metal forming method. Similar to the front section 102 described above, the rear section 112 is formed without joining of multiple parts, thereby eliminating manufacturing steps associated with processing of welding joints, and providing manufacturing time and cost savings.

As shown in FIG. 6A, the rear section 112 includes a fore end 114 having an engagement feature 116 configured to releasably engage a corresponding engagement feature 118 provided on the aft end 88 of the nose portion 82. For example, the engagement features 116, 118 may include threaded portions, whereby a threaded portion of the nose portion 82 may be threadedly engaged with a threaded portion of the rear section 112. The engagement features 116, 118 may include any other suitable mechanical fastening elements that enable the nose portion 82 to be securely yet releasably joined to the rear section 112. Advantageously, the releasable joining of the nose portion 82 to the rear section 112 enables an explosive payload (not shown) carried in the central cavity 18 to be removed from the casing 110 if and when desired, while maintaining a secure connection between the nose portion 82 and the rear section 112 when assembled. Moreover, the aft wall 30 integrally formed in the rear section 112 provides pre-detonation structural integrity superior to that of prior known designs, as discussed above.

The warhead casings manufactured according to the embodiments of the invention shown and described herein include an overall exterior profile shape and weight distribution substantially similar to those of prior known designs, which provides advantages for implementing the invention with existing systems developed for use with prior designs.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A warhead casing, comprising:

a nose region, a tail region, and a tubular body region therebetween, the regions defining a lengthwise axis of the casing;

a central cavity extending along the lengthwise axis and having a first axial end and a second axial end, the central cavity having a diameter and being defined within circumferential outer walls of the nose, tail, and tubular body regions;

an aft wall formed integrally with the tail region and extending radially toward the lengthwise axis to define the second end of the central cavity, whereby the aft wall remains integral with the tail portion when the casing expands radially upon impact and before detonation, the aft wall including an aperture configured to receive a fuse device and extending axially through the aft wall, the aperture having a diameter that is no more than half the diameter of the central cavity in the tail region.

2. The warhead casing of claim 1, further comprising:

a socket formed in an outer wall of the tail region and substantially aligned with the aft wall along the lengthwise axis, the socket configured to receive a sensor device.

3. A warhead casing, comprising:

a nose region, a tail region, and a tubular body region therebetween, the regions defining a lengthwise axis of the casing;

a central cavity extending along the lengthwise axis and having a first axial end and a second axial end;

an aft wall formed integrally with the tail region and extending radially toward the lengthwise axis to define the second end of the central cavity, the aft wall including an aperture configured to receive a fuse device; and a passageway extending radially through the aft wall between the socket and the aperture, the passageway configured to receive a cable for connecting the sensor device to the fuse device.

4. The warhead casing of claim 3, wherein the passageway includes a first branch and a second branch separate from the first branch, the first branch configured to receive the cable for connecting to a first portion of the fuse device, and the second branch configured to receive the cable for connecting to a second portion of the fuse device.

5. The warhead casing of claim 1, wherein the tubular body region is symmetric about the lengthwise axis.

6. The warhead casing of claim 1, wherein the tubular body region is continuous about the lengthwise axis such that the casing does not include an aperture extending from an outer periphery of the tubular body region into the central cavity.

7. The warhead casing of claim 1, wherein the casing is monolithic.

8. A method of manufacturing a warhead casing, comprising the steps of:

independently forming a nose portion, a body portion, and a tail portion, including forming the tail portion with a circumferential outer wall defining an inner cavity and an aft wall integrally formed with the circumferential outer wall and extending radially inward to define an axial end of the inner cavity, the aft wall including an aperture extending therethrough smaller in diameter than the inner cavity and configured to receive a fuse device;

permanently joining the nose portion to a first end of the body portion by welding;

processing a first internal connection area between the nose portion and the body portion to remove irregularities caused by welding and create a smooth and continuous inner surface, accessing the first internal connection area through an open second end of the body portion;

permanently joining the second end of the body portion to the tail portion by welding;

processing a second internal connection area between the body portion and the tail portion to remove irregularities caused by welding and create a smooth and continuous inner surface, accessing the second internal connection area through the aft wall aperture.

9. The method of claim 8, wherein forming the tail portion includes forming a socket in the circumferential outer wall, the socket substantially aligned with the aft wall and configured to receive a sensor device.

* * * * *